US008418382B2

(12) United States Patent
Madore et al.

(10) Patent No.: US 8,418,382 B2
(45) Date of Patent: Apr. 16, 2013

(54) SOLE STRUCTURE AND ARTICLE OF FOOTWEAR INCLUDING SAME

(75) Inventors: Carl L. Madore, Portland, OR (US); Nicole Mueller, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 56 days.

(21) Appl. No.: 13/049,422

(22) Filed: Mar. 16, 2011

(65) Prior Publication Data

US 2012/0233886 A1 Sep. 20, 2012

(51) Int. Cl.
*A43B 5/00* (2006.01)
*A43C 15/16* (2006.01)

(52) U.S. Cl.
USPC ..... 36/102; 36/127; 36/59 R

(58) Field of Classification Search ..... 36/102, 36/127, 59 R, 59 C
See application file for complete search history.

(56) References Cited

U.S. PATENT DOCUMENTS

| | | | |
|---|---|---|---|
| D15,185 | S | 8/1884 | Brooks |
| 1,087,212 | A | 2/1914 | Caldwell |
| 1,355,827 | A | 10/1920 | Finneran |
| 1,528,782 | A | 11/1924 | Perry |
| 1,736,576 | A | 11/1929 | Cable |
| D81,917 | S | 9/1930 | Burchfield |
| 1,876,195 | A | 9/1932 | Youmans |
| D171,130 | S | 12/1953 | Gruner |
| D201,865 | S | 8/1965 | Bingham, Jr. et al. |
| 3,328,901 | A | 7/1967 | Strickland |
| 3,341,952 | A | 9/1967 | Dassler |
| D213,416 | S | 3/1969 | Dittmar et al. |
| D219,503 | S | 12/1970 | Vietas |
| 3,597,863 | A | 8/1971 | Austin et al. |
| 3,656,245 | A | 4/1972 | Wilson |
| 4,096,649 | A | 6/1978 | Saurwein |
| 4,107,858 | A | 8/1978 | Bowerman et al. |
| D255,957 | S | 7/1980 | Pasquier |
| 4,245,406 | A | 1/1981 | Landay et al. |
| 4,315,374 | A | 2/1982 | Sneeringer |
| 4,335,530 | A | 6/1982 | Stubblefield |
| 4,347,674 | A | 9/1982 | George |
| 4,392,312 | A | 7/1983 | Crowley et al. |
| D271,159 | S | 11/1983 | Muller-Feigelstock |
| D272,200 | S | 1/1984 | Autry et al. |
| D272,772 | S | 2/1984 | Kohno |
| 4,454,662 | A | 6/1984 | Stubblefield |
| D278,759 | S | 5/1985 | Norton et al. |
| 4,574,498 | A | 3/1986 | Norton et al. |
| 4,586,274 | A | 5/1986 | Blair |

(Continued)

FOREIGN PATENT DOCUMENTS

| | | |
|---|---|---|
| DE | 3135347 | 3/1983 |
| DE | 3706069 | 9/1988 |

(Continued)

OTHER PUBLICATIONS

Pending U.S. Appl. No. 13/234,182, filed Sep. 16, 2011.

(Continued)

*Primary Examiner* — Ted Kavanaugh
(74) *Attorney, Agent, or Firm* — Banner & Witcoff, Ltd.

(57) ABSTRACT

A sole structure can include one or more ridge tractions elements. The ridge traction elements can be separated by one or more flexure zones. The sole structure can also include other types of traction elements.

28 Claims, 7 Drawing Sheets

U.S. PATENT DOCUMENTS

| | | | | |
|---|---|---|---|---|
| D287,662 | S | 1/1987 | Tonkel | |
| 4,689,901 | A | 9/1987 | Ihlenburg | |
| 4,698,923 | A | 10/1987 | Arff | |
| D294,655 | S | 3/1988 | Heyes | |
| D295,231 | S | 4/1988 | Heyes | |
| 4,858,343 | A | 8/1989 | Flemming | |
| 5,025,573 | A | 6/1991 | Giese et al. | |
| 5,174,049 | A | 12/1992 | Flemming | |
| 5,201,126 | A | 4/1993 | Tanel | |
| D339,459 | S | 9/1993 | Yoshikawa et al. | |
| 5,335,429 | A | 8/1994 | Hansen | |
| 5,406,723 | A | 4/1995 | Okajima | |
| 5,452,526 | A | 9/1995 | Collins | |
| 5,461,801 | A | 10/1995 | Anderton | |
| 5,473,827 | A | 12/1995 | Barre et al. | |
| D368,156 | S | 3/1996 | Longbottom et al. | |
| D368,360 | S | 4/1996 | Wolfe | |
| D369,672 | S | 5/1996 | Tanaka et al. | |
| 5,524,364 | A | 6/1996 | Cole et al. | |
| 5,555,650 | A | 9/1996 | Longbottom et al. | |
| 5,572,807 | A | 11/1996 | Kelly et al. | |
| 5,617,653 | A | 4/1997 | Walker et al. | |
| 5,678,328 | A | 10/1997 | Schmidt et al. | |
| D387,892 | S | 12/1997 | Briant | |
| D389,298 | S | 1/1998 | Briant | |
| 5,709,954 | A | 1/1998 | Lyden et al. | |
| D394,943 | S | 6/1998 | Campbell et al. | |
| 5,761,832 | A | 6/1998 | George | |
| 5,806,209 | A * | 9/1998 | Crowley et al. | 36/28 |
| 5,832,636 | A | 11/1998 | Lyden et al. | |
| 5,943,794 | A | 8/1999 | Gelsomini | |
| 5,987,783 | A | 11/1999 | Allen et al. | |
| 6,016,613 | A | 1/2000 | Campbell et al. | |
| D421,833 | S | 3/2000 | Fallon | |
| 6,035,559 | A | 3/2000 | Freed et al. | |
| D427,754 | S | 7/2000 | Portaud | |
| 6,101,746 | A | 8/2000 | Evans | |
| 6,145,221 | A | 11/2000 | Hockerson | |
| 6,161,315 | A * | 12/2000 | Dalton | 36/134 |
| D437,108 | S | 2/2001 | Peabody | |
| D437,989 | S | 2/2001 | Cass | |
| 6,199,303 | B1 | 3/2001 | Luthi et al. | |
| 6,231,946 | B1 | 5/2001 | Brown, Jr. et al. | |
| 6,354,022 | B2 | 3/2002 | Gelsomini | |
| D461,297 | S | 8/2002 | Lancon | |
| D477,905 | S | 8/2003 | Adams et al. | |
| D478,714 | S | 8/2003 | Recchi | |
| 6,615,512 | B2 | 9/2003 | Sink | |
| 6,708,427 | B2 | 3/2004 | Sussmann et al. | |
| 6,725,574 | B2 | 4/2004 | Hokkirigawa et al. | |
| 6,754,984 | B2 | 6/2004 | Schaudt et al. | |
| 6,892,479 | B2 | 5/2005 | Auger et al. | |
| 6,935,055 | B2 | 8/2005 | Oorei | |
| 6,941,684 | B2 | 9/2005 | Auger et al. | |
| 6,954,998 | B1 | 10/2005 | Lussier | |
| 6,968,637 | B1 | 11/2005 | Johnson | |
| 6,973,745 | B2 | 12/2005 | Mills et al. | |
| 6,973,746 | B2 | 12/2005 | Auger et al. | |
| 7,007,410 | B2 | 3/2006 | Auger et al. | |
| D525,416 | S | 7/2006 | Auger et al. | |
| 7,143,530 | B2 | 12/2006 | Hudson et al. | |
| 7,181,868 | B2 | 2/2007 | Auger et al. | |
| 7,204,044 | B2 | 4/2007 | Hoffer et al. | |
| D571,092 | S | 6/2008 | Norton | |
| D571,542 | S | 6/2008 | Wilken | |
| D573,779 | S | 7/2008 | Stauffer | |
| 7,401,418 | B2 | 7/2008 | Wyszynski et al. | |
| D575,041 | S | 8/2008 | Wilken | |
| 7,406,781 | B2 | 8/2008 | Scholz | |
| D578,280 | S | 10/2008 | Wilken | |
| 7,441,350 | B2 | 10/2008 | Auger et al. | |
| 7,536,810 | B2 | 5/2009 | Jau et al. | |
| 7,650,707 | B2 * | 1/2010 | Campbell et al. | 36/127 |
| 7,654,014 | B1 | 2/2010 | Moore et al. | |
| 7,665,229 | B2 | 2/2010 | Kilgore et al. | |
| 7,673,400 | B2 | 3/2010 | Brown et al. | |
| 7,685,741 | B2 | 3/2010 | Friedman | |
| 7,685,745 | B2 | 3/2010 | Kuhtz et al. | |
| 7,762,009 | B2 | 7/2010 | Gerber | |
| 7,866,064 | B2 | 1/2011 | Gerber | |
| 2005/0097783 | A1 | 5/2005 | Mills et al. | |
| 2005/0120593 | A1 | 6/2005 | Mason | |
| 2006/0042124 | A1 | 3/2006 | Mills et al. | |
| 2006/0242863 | A1 * | 11/2006 | Patmore | 36/127 |
| 2007/0039209 | A1 | 2/2007 | White et al. | |
| 2007/0199211 | A1 * | 8/2007 | Campbell | 36/59 R |
| 2007/0266597 | A1 | 11/2007 | Jones | |
| 2008/0010863 | A1 | 1/2008 | Auger et al. | |
| 2008/0098624 | A1 | 5/2008 | Goldman | |
| 2009/0019732 | A1 | 1/2009 | Sussmann | |
| 2009/0100716 | A1 | 4/2009 | Gerber | |
| 2009/0100718 | A1 | 4/2009 | Gerber | |
| 2009/0113758 | A1 | 5/2009 | Nishiwaki et al. | |
| 2009/0241377 | A1 | 10/2009 | Kita et al. | |
| 2009/0249652 | A1 | 10/2009 | Gunthel et al. | |
| 2009/0272008 | A1 | 11/2009 | Nomi et al. | |
| 2009/0293315 | A1 | 12/2009 | Auger et al. | |
| 2010/0050471 | A1 | 3/2010 | Kim | |
| 2010/0126044 | A1 | 5/2010 | Davis | |
| 2010/0199523 | A1 | 8/2010 | Mayden et al. | |
| 2010/0229427 | A1 | 9/2010 | Campbell et al. | |
| 2010/0313447 | A1 * | 12/2010 | Becker et al. | 36/102 |
| 2011/0088287 | A1 | 4/2011 | Auger et al. | |

FOREIGN PATENT DOCUMENTS

| | | |
|---|---|---|
| DE | 4417563 | 11/1995 |
| DE | 19817579 | 10/1999 |
| EP | 115663 | 8/1984 |
| EP | 123550 | 10/1984 |
| GB | 2113971 | 8/1983 |
| GB | 2425706 | 11/2006 |
| JP | 10066605 | 3/1998 |
| JP | 2002306207 | 10/2000 |
| JP | 2002272506 | 9/2002 |
| JP | 2005185303 | 7/2005 |
| JP | 2005304653 | 11/2005 |
| JP | 2008212532 | 9/2008 |
| WO | 03045182 | 6/2003 |

OTHER PUBLICATIONS

Pending U.S. Appl. No. 13/234,183, filed Sep. 16, 2011.
Pending U.S. Appl. No. 13/234,185, filed Sep. 16, 2011.
Pending U.S. Appl. No. 13/009,549, filed Jan. 19, 2011.
Pending U.S. Appl. No. 13/234,244, filed Sep. 16, 2011.
Pending U.S. Appl. No. 12/582,252, filed Oct. 20, 2009.
Pending U.S. Appl. No. 13/234,233, filed Sep. 16, 2011.
Pending U.S. Appl. No. 13/234,180, filed Sep. 16, 2011.

* cited by examiner

SOLE STRUCTURE AND ARTICLE OF FOOTWEAR INCLUDING SAME

BACKGROUND

"Outsole" is a term often used to describe bottom portions of a shoe sole structure. An outsole, or various parts of the outsole, will typically contact the ground when a shoe wearer stands or when the wearer walks or otherwise moves relative to the ground. In sports and other activities, a person's feet may experience a wide range of motion and/or support that person's weight during a range of different body motions. A sole structure designed to provide support or otherwise enhance performance during one type of motion may not be ideal for a different type of motion that a shoe wearer might also perform. For instance, some types of outsole elements may help increase traction when a shoe wearer walks or otherwise traverses various types of surfaces. However, that same shoe may also be worn when performing other activities that do not require that same type of propulsive effort. During those other activities it may be more desirable to stabilize the wearer foot during body motions that differ from motions experienced while walking.

Golf is one example of an activity in which a person's feet repeatedly experience different types of motions and body positions. A golfer may spend large amounts of time walking. Much of that walking may be over uneven surfaces and/or surfaces that might be slippery. It may thus be desirable to include outsole elements to increase traction when moving across such surfaces. However, the manner in which a golfer swings a club is an important aspect of golf. Proper foot placement and support are important during a golf swing. Because of differences between walking motions and swing motions, sole structures that increase traction while walking a golf course may not be the best structures to stabilize a wearer's feet while swinging a golf club.

SUMMARY

This Summary is provided to introduce a selection of concepts in a simplified form that are further described below in the Detailed Description. This Summary is not intended to identify key or essential features of the invention.

In at least some embodiments, a sole structure includes a ridge traction element. The ridge traction element may include a peripheral segment and an associated transverse segment. The peripheral segment may be proximate and generally aligned with a medial or lateral edge of the sole structure. The transverse segment may extend from the associated peripheral segment and across the sole structure, and may have a height that decreases over the length of the transverse segment. The sole structure can include multiple ridge traction elements, which multiple elements can be separated by one or more flexure zones.

In some embodiments, a sole structure may include additional types of traction elements, some or all of which may be located in regions of the sole structure at least partially defined by one or more ridge tractions elements. In certain embodiments, those additional traction element types can include one or more of tab traction elements, stud tractions elements and/or concave traction element clusters.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Figure 1:
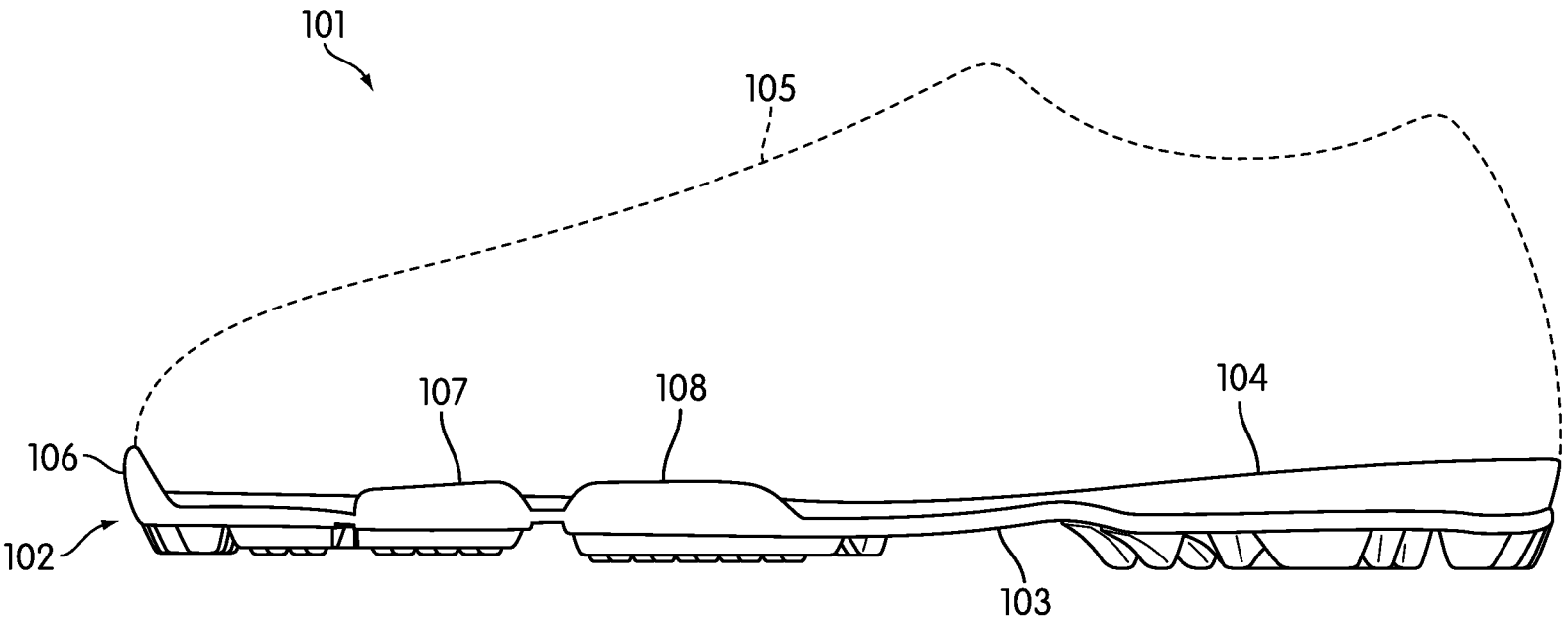
FIG. 1 is a lateral side view of an article of footwear according to some embodiments.

FIG. 1 is a lateral side view of a shoe 101 according to some embodiments. Shoe 101 can be a shoe intended for wear by a golfer. Embodiments can also include footwear for use in other athletic and non-athletic activities. Shoe 101 includes a sole structure 102. Although various specific features of sole structure 102 are described below, such description merely provides examples of features according to certain embodiments.

Sole structure 102 includes a outsole 103 and a midsole 104. These and other components of sole structure 102 are further described below. In other embodiments, a sole structure may only include an outsole or might otherwise lack a separate midsole. In still other embodiments, a sole structure could include a support plate and/or other component(s). Shoe 101 also includes an upper 105. Shoes having sole structures according to various embodiments can include various types of uppers. Because the details of such uppers are not pertinent to understanding sole structures disclosed herein, upper 105 is shown generically in FIG. 1 using a broken line. Elements 106, 107 and 108 of outsole 103 are also discussed below.

Figure 2:
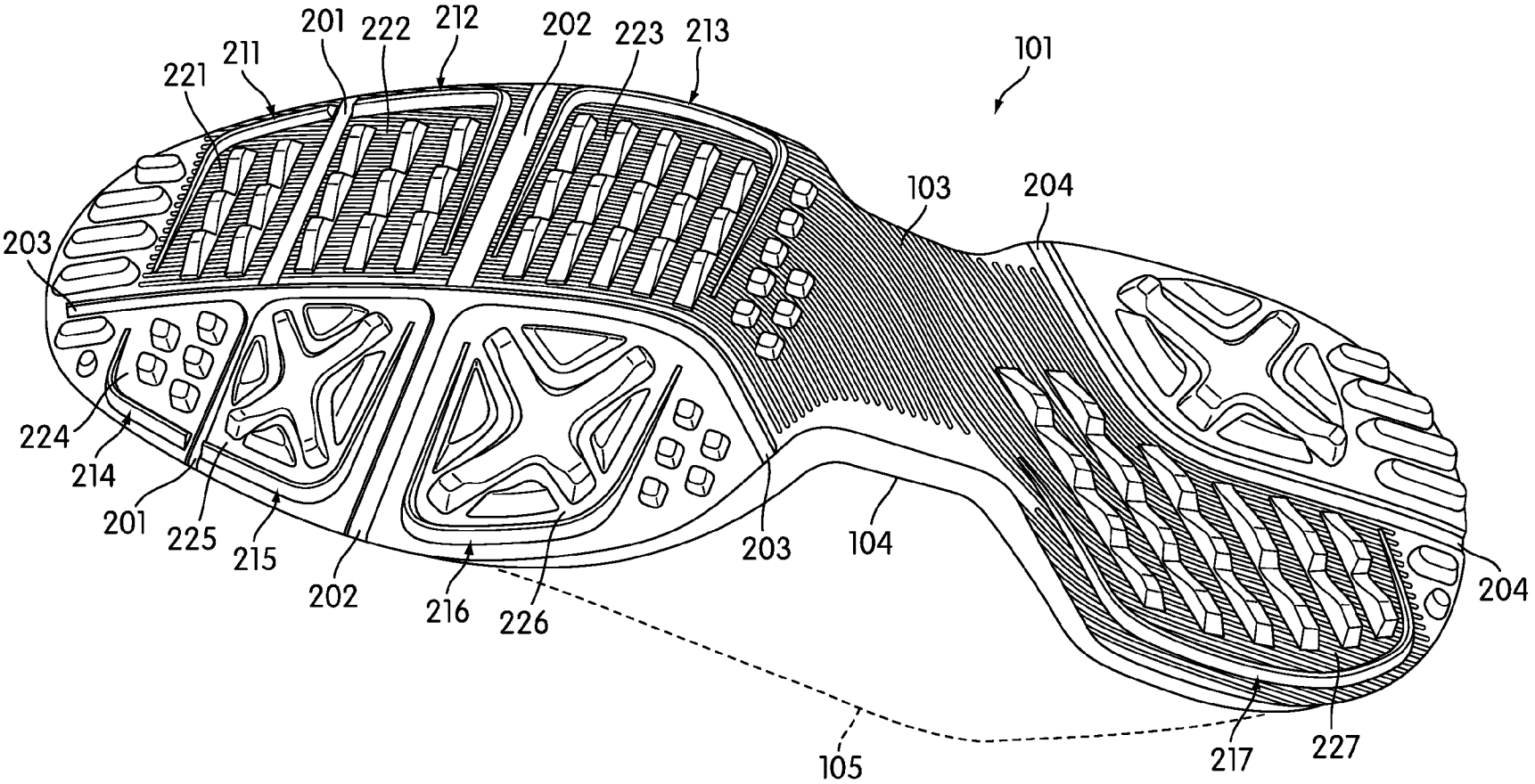
FIG. 2 is a medial bottom perspective view of the shoe from FIG. 1.

FIG. 2 is a medial bottom perspective view of shoe 101 showing details of outsole 103. The locations of certain regions in sole structure 102, and in sole structures according to other embodiments, may be described using references to human foot anatomy. Specifically, various regions of a described sole structure may be identified using foot bones of a person wearing a shoe that includes the described sole structure. Identifications in this manner assume that the shoe is properly sized for the wearing foot.

When referring to an outsole or other component of a sole structure, a "forefoot" region will generally lie under or near the metatarsal and phalangeal bones of a shoe wearer's foot and may extend beyond the wearer's toes to the frontmost portion of the shoe. A forefoot region may extend beyond the medial or lateral peripheral edge of the wearer's foot. A "midfoot" region will generally lie under or near the cuboid, navicular, medial cuneiform, intermediate cuneiform and lateral cuneiform bones of the wearer's foot. A midfoot region may also extend beyond the medial or lateral peripheral edge of the wearer's foot. A "hindfoot" region of a sole structure extends from the midfoot region and under/near the wearer calcaneus (heel bone), may extend to the rearmost portion of the shoe, and may also extend beyond the medial or lateral peripheral edge of the wearer's foot. One or more of the above-described regions may overlap, and description of a component by reference to a particular anatomical region does not require that the component cover that entire anatomical region. For example, and as discussed in more detail below in connection with FIG. 6, a forefoot region of an outsole according to some embodiments may include an opening exposing a portion of a midsole.

Returning to FIG. 2, outsole 103 covers the entire bottom surface of shoe 101. In other embodiments, an example of which is discussed in connection with FIGS. 6 and 7, an outsole may not cover the entire bottom surface and may include openings that expose a midsole or other shoe component. Outsole 103 includes multiple flexure zones 201, 202, 203 and 204. Each of these flexure zones comprises a region of outsole 103 that is more flexible than adjacent regions of outsole 103. In the embodiment of outsole 103, flexure zones 201-204 are regions in which the material of outsole 103 has been thinned, and in which there are no traction elements present. In other embodiments, a flexure zone may be formed in some other manner and/or include traction elements.

Forefoot flexure zone 201 extends across outsole 103 in a medial-lateral direction. A portion of zone 201 is approximately located under the first interphalangeal joint and under the second proximal interphalangeal joint. Forefoot flexure zone 202 also extends across outsole 103 in medial-lateral direction, but is closer to the ball of the foot. Zone 202 is approximately located under the proximal ends of the proximal phalangeal bones. Longitudinal flexure zone 203 extends in a front to rear direction in the forefoot and midfoot regions before turning toward the medial side. Flexure zone 203 approximately lies under the space separating the first phalangeal bones and first metatarsal distal end from the second phalangeal bones and second metatarsal distal end. Hindfoot flexure zone 204 extends from the rear of outsole 103, approximately centered between the lateral and medial sides and under the calcaneus, and turns toward the lateral side.

In addition to flexure zones, outsole 103 includes multiple traction elements of various types. These traction elements extend outward from one or more base surfaces of outsole 103. When outsole 103 (or a portion thereof) contacts the ground, the traction elements can penetrate into grass, sand or other ground material so as to increase traction and enhance stability of the shoe wearer foot. As explained in more detail below, different traction element types are configured to increase traction and foot stability under different conditions. Outsole 103 includes ridge traction elements, tab traction elements, stud traction elements, and concave traction element clusters. Although all of these traction elements are visible in FIG. 2, only ridge traction elements 211, 212, 213, 214, 215, 216 and 217 are marked. So as to avoid confusing FIG. 2 by including an excessive number of lead lines and reference characters, other types of traction elements (and additional details of ridge traction elements 211-217) will be identified in FIGS. 3 and 4.

In the embodiment of outsole 103, each of ridge traction elements 211-217 is a generally continuous, outwardly-extending, elongated protrusion from a base surface of outsole 3. For example, ridge traction elements 214-216 respectively extend outward from smooth base surfaces 224-226. Ridge traction elements 211-213 and 217 respectively extend outward from grooved base surfaces 221-223 and 227. Each of ridge traction elements 211-217 also includes multiple segments. Some segment ends are joined to ends of other segments. Other segment ends terminate in free ends.

Figure 3:
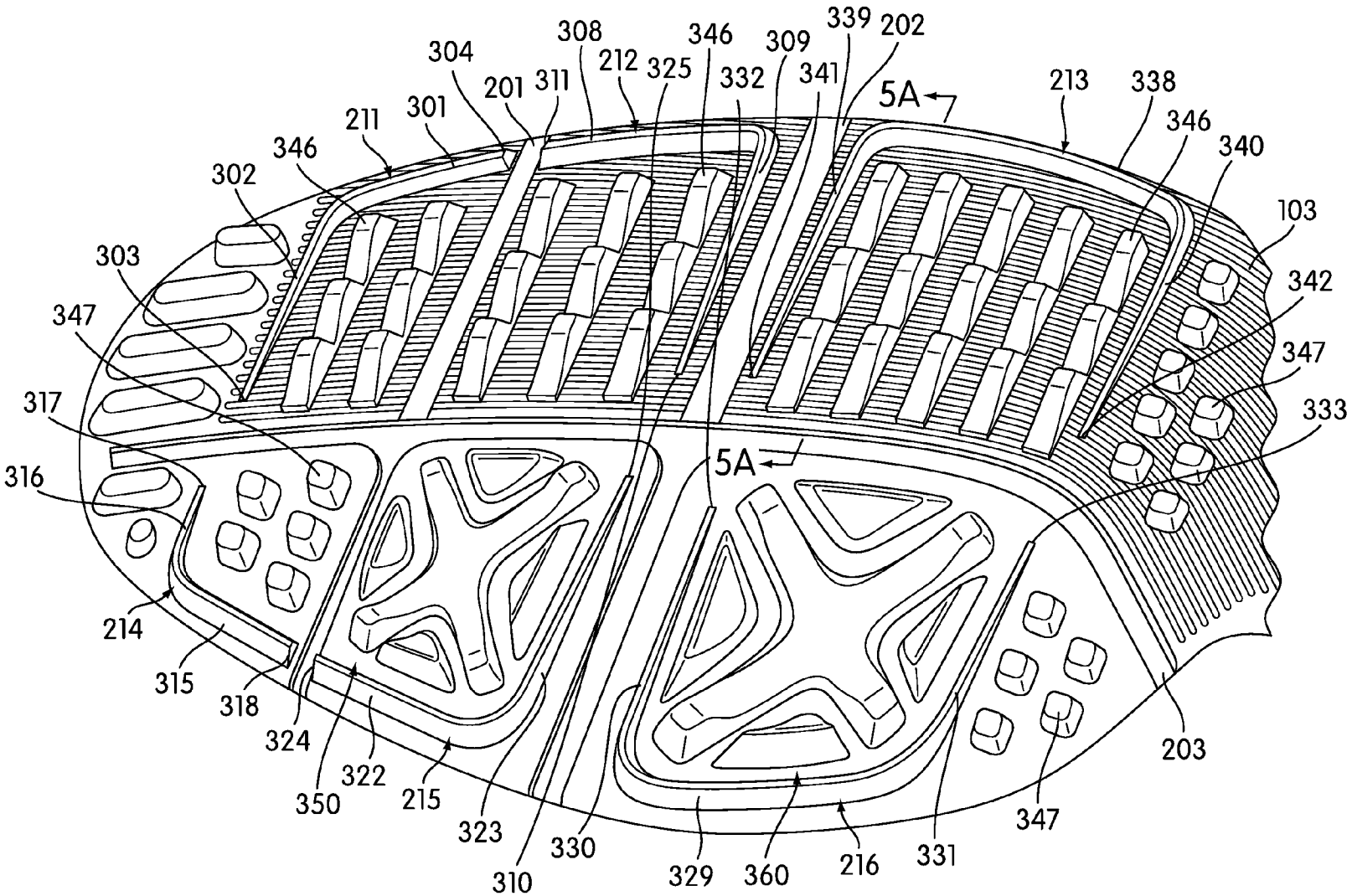
FIG. 3 is an enlarged medial bottom perspective view showing a front portion of the sole structure of the shoe from FIG. 1.

FIG. 3 is an enlarged medial bottom perspective view showing a front portion of outsole 103. Ridge traction element 211 includes a peripheral segment 301 that is near and generally parallel to a portion of the lateral outer edge of outsole 3. Ridge traction element 211 also includes a transverse segment 302. Transverse segment 302, a lateral end of which is joined to a forward end of peripheral segment 301, extends at an angle from peripheral segment 301 and toward the medial side of outsole 103. Segments 301 and 302 respectively terminate in free ends 304 and 303. An interior region partially bounded by the medial side of segment 301 and the rear side of segment 302 includes six tab traction elements 346; tab traction elements are discussed below. Ridge traction element 212 includes a peripheral segment 308 near and generally parallel to another part of the lateral edge of outsole 103, a transverse segment 309 extending at an angle from peripheral segment 308 toward the medial side of outsole 103, and free ends 310 and 311. An interior region partially bounded by the medial side of segment 308 and the forward side of segment 309 includes nine tab traction elements 346.

Ridge traction elements 214 and 215 are respectively similar to ridge traction elements 211 and 212, but are instead located on the medial side of outsole 103. Ridge traction element 214 includes a peripheral segment 315 near and generally parallel to a part of the medial edge of outsole 103. A transverse segment 316 extends at an angle from peripheral segment 315 toward the lateral side of outsole 103. Free ends 317 and 318 respectively terminate segments 316 and 315. Five stud traction elements 347 are located in the interior region partially bounded by the lateral side of segment 315 and the rear side of segment 317. Stud traction elements are discussed below.

Ridge traction element 215 includes a peripheral segment 322 near and generally parallel to another part of the medial edge of outsole 102, a transverse segment 323 extending at an angle from peripheral segment 322 toward the lateral side of outsole 103, and free ends 324 and 325. A concave traction element cluster 350 is located in the interior region partially bounded by the lateral side of segment 322 and the forward side of segment 323. Concave traction element clusters are discussed below.

Each of ridge traction elements 213 and 216 includes a second transverse segment. For example, ridge traction element 213 includes a peripheral segment 338 that is near and generally parallel to a part of the outsole 103 lateral edge. A first transverse segment 339 extends at an angle from a portion of segment 338 toward the medial side of outsole 103 and terminates in a free end 341. A second transverse segment 340 extends at an angle from a different portion of peripheral segment 338 toward the medial side of outsole 103 and terminates in a free end 342. Fifteen tab traction elements 346 are located in the interior region partially bounded by the rear side of segment 339, the medial side of segment 338, and the forward side of segment 340. Ridge traction element 216 includes a peripheral segment 329 that is near and generally parallel to a part of the outsole 103 medial edge, a first transverse segment 330 extending at an angle from peripheral segment 329 toward the lateral side of outsole 103, a second transverse segment 331 extending at an angle from peripheral segment 329 toward the lateral side of outsole 103, and free ends 332 and 333. A concave traction element cluster 360 is located in the interior region partially bounded by the rear side of segment 330, the lateral side of segment 329, and the forward side of segment 331.

Figure 4:
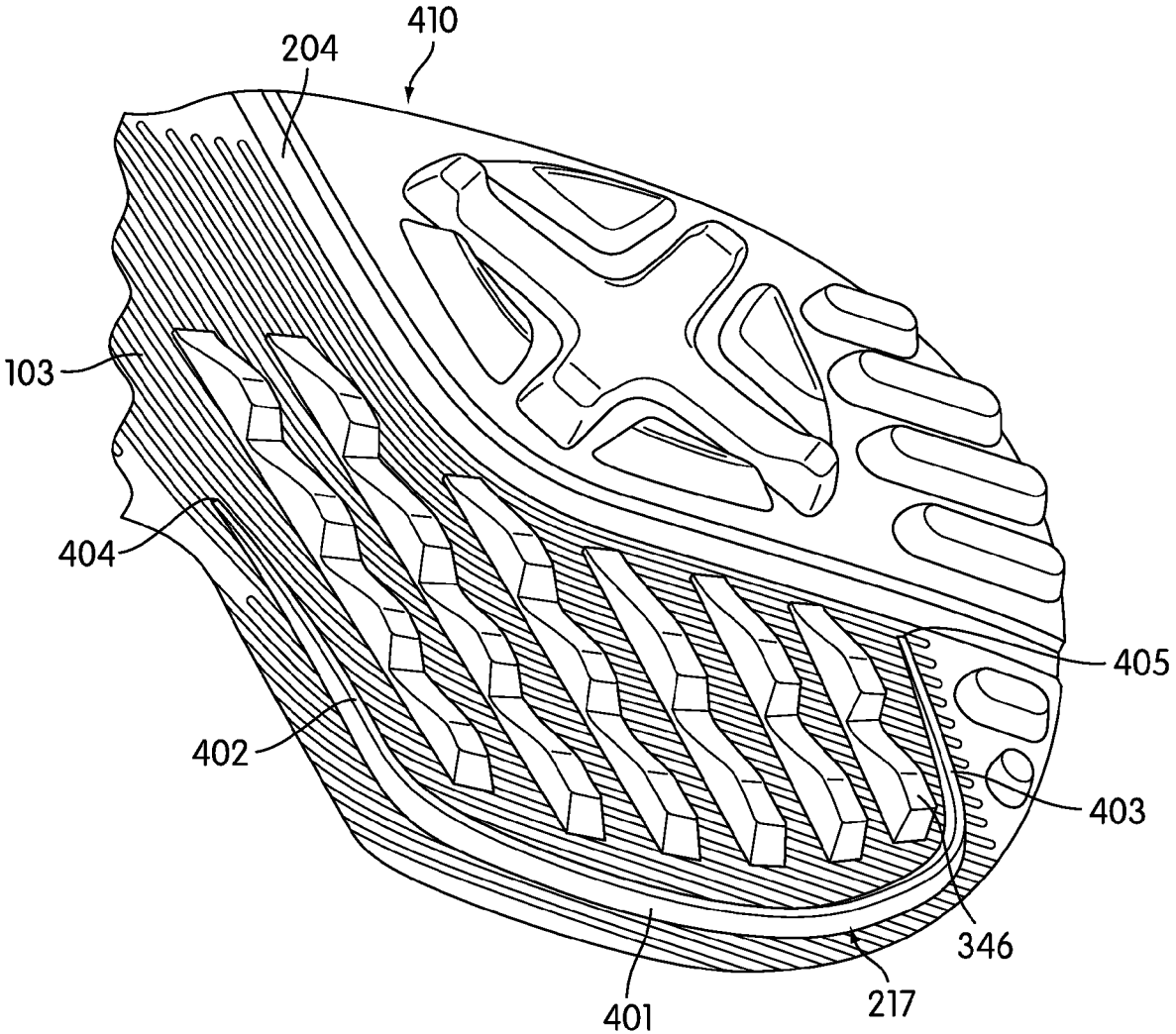
FIG. 4 is an enlarged medial bottom perspective view showing a rear portion of the sole structure of the shoe from FIG. 1.

FIG. 4 is an enlarged medial bottom perspective view showing a rear portion of outsole 103. Ridge traction element 217, located in the hindfoot region of outsole 103, includes two peripheral segments. A first peripheral segment 402 is near and generally parallel to a first part of the outsole 103 medial edge in the hindfoot region, and includes a free end 404. A second peripheral segment 401 is near and generally parallel to a second part of the outsole 103 medial edge in the hindfoot region and is connected to segment 402. A transverse segment 403 extends at an angle from a different part of segment 401 toward the lateral side of outsole 103 and terminates in a free end 405. Seventeen tab traction elements 346 are located in the interior region partially bounded by segments 401-403.

Each of peripheral segments 301, 308, 338, 315, 322, 329 and 401 is positioned so as to be located near or just outside the outer periphery of a wearer's foot. As explained in further detail below, this helps to stabilize the wearer's foot during a golf swing. In the embodiment of outsole 103, for example, peripheral segment 338 is located laterally of the distal half of the fifth metatarsal. Peripheral segments 308 and 301 are located laterally of the fifth, fourth and third toes. In the embodiment of outsole 103, each of peripheral segments 301, 308, 338, 315, 322, 329 and 401 is slightly inside of the outer edge of outsole 103. In other embodiments, one or more peripheral segments could be flush with (or form a part of) an outsole outer edge.

Figure 5A:
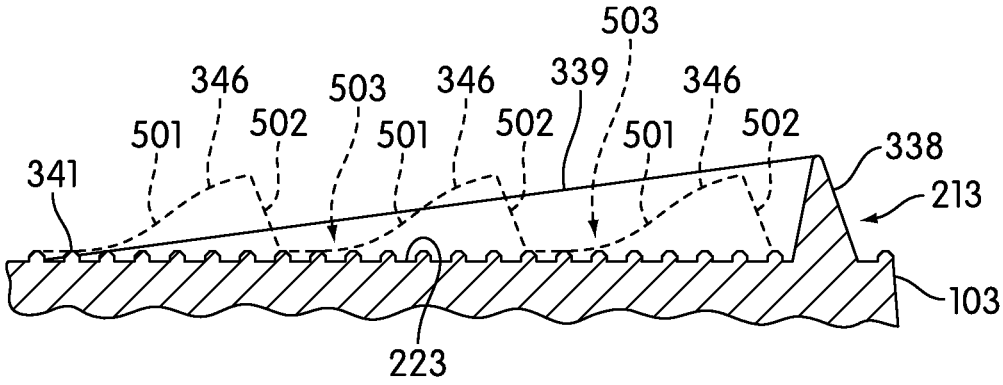
FIG. 5A is a cross-sectional view taken from the location indicated in FIG. 3.

Each of transverse segments 302, 309, 339, 340, 316, 323, 330, 331 and 403 has a height that decreases along the length of the segment toward the interior of outsole 103. In the embodiment of outsole 103, this height decrease takes the form of a relatively linear taper. This can be seen more clearly in FIG. 5A. FIG. 5A is a cross-sectional view taken from the location indicated in FIG. 3. Tab elements 346 are shown with broken lines in FIG. 5A. As shown in FIG. 5A, transverse segment 339 tapers from a maximum height at its junction with peripheral segment 338 to a minimum height at free end 341. Transverse segments 302, 309, 340, 316, 323, 330, 331 and 403 taper in a similar manner, but have varying lengths.

In the embodiment of outsole 103, and as also seen in FIG. 5A, peripheral segment 338 of ridge traction elements 213 has a generally triangular cross-section. Peripheral segments 301, 308, 315, 322, 329 and 401 have similar triangular cross-sections. Transverse segments 302, 309, 339, 346, 316, 323, 330, 331 and 403 and peripheral segment 402 also have triangular cross-sections. However, the cross-section of each of segments 302, 309, 339, 346, 316, 323, 330, 331, 403 and 402 may be narrower than the cross-section of the associated peripheral segment from which it extends (e.g., transverse segments 339 and 340 may have narrower cross-sections and/or steeper side walls than associated peripheral segment 338). The triangular cross-sections of ridge traction elements 211-217 help those ridge traction elements to more easily penetrate a ground surface. Ridge traction elements according to various embodiments could have other types of triangular cross-sections. For example, a ridge traction element could have a cross section in the shape of a right triangle or other type of non-isosceles triangle. The cross-section of a ridge traction element need not be triangular. A cross-section could also vary along the length of a ridge traction element segment.

So as not to interfere with flexibility afforded by flexure zones 201-204, no segments of ridge traction elements 211-217 cross any of flexure zones 201-204.

In addition to ridge traction elements, outsole 3 includes numerous tab traction elements 346. In the embodiment of outsole 103, and as indicated in FIG. 3, six tab traction elements 346 are located in the region partially bounded by ridge traction element 211, nine tab traction elements 346 are located in the region partially bounded by ridge traction element 212, and fifteen tab traction elements 346 are located in the region partially bounded by ridge traction element 213. As indicated in FIG. 4, seventeen tab traction elements 346 are located in the region partially bounded by ridge traction element 217.

Although individual tab traction elements 346 may vary somewhat in size and shape, each has an average length along a length axis that is greater than its width along a width axis. The length axes of the forefoot tab traction elements 346 in the regions partially bounded by ridge traction elements 211-213 generally extend across outsole 103 in a medial-lateral direction. The length axes of hind- and midfoot tab traction elements 346 in the region partially bounded by ridge traction element 217 also extend across outsole 103 in a medial-lateral direction, but are positioned at angles that are more diagonal relative to a longitudinal axis of outsole 103. These tab traction elements 346 in the region partially bounded by ridge traction element 217 generally extend in a rear medial to lateral forward direction so as to help counteract twisting motion of a foot as a wearer of shoe 101 swings a golf club.

Tab traction elements may also have at least one end that is rounded or otherwise sloped. As seen most clearly in FIG. 5A, tab traction elements 346 have a shape similar to that of a cresting wave. The rounded sides 501 of the forefoot tab traction elements face toward the medial side of outsole 103. As discussed in more detail below, the sloped sides 501 facilitate medial-to-lateral rolling of the foot. Straight sides 502 of these forefoot tab traction elements 346 face toward the lateral side. Spaces 503 separate tab traction elements. As seen in FIG. 4, the rounded sides of hind- and midfoot tab traction elements 346 face toward the lateral side of outsole 103.

Outsole 103 further includes numerous stud traction elements 347. In the embodiment of outsole 103, five stud traction elements 347 are located in the region partially bounded by ridge traction element 214. Five more stud traction elements 347 are located to the rear of transverse segment 331, and eight additional stud traction elements 347 are located to the rear of transverse segment 340. Unlike tab traction elements 346, each of stud traction elements 347 has a length that is approximately the same as its width.

Figure 5B:
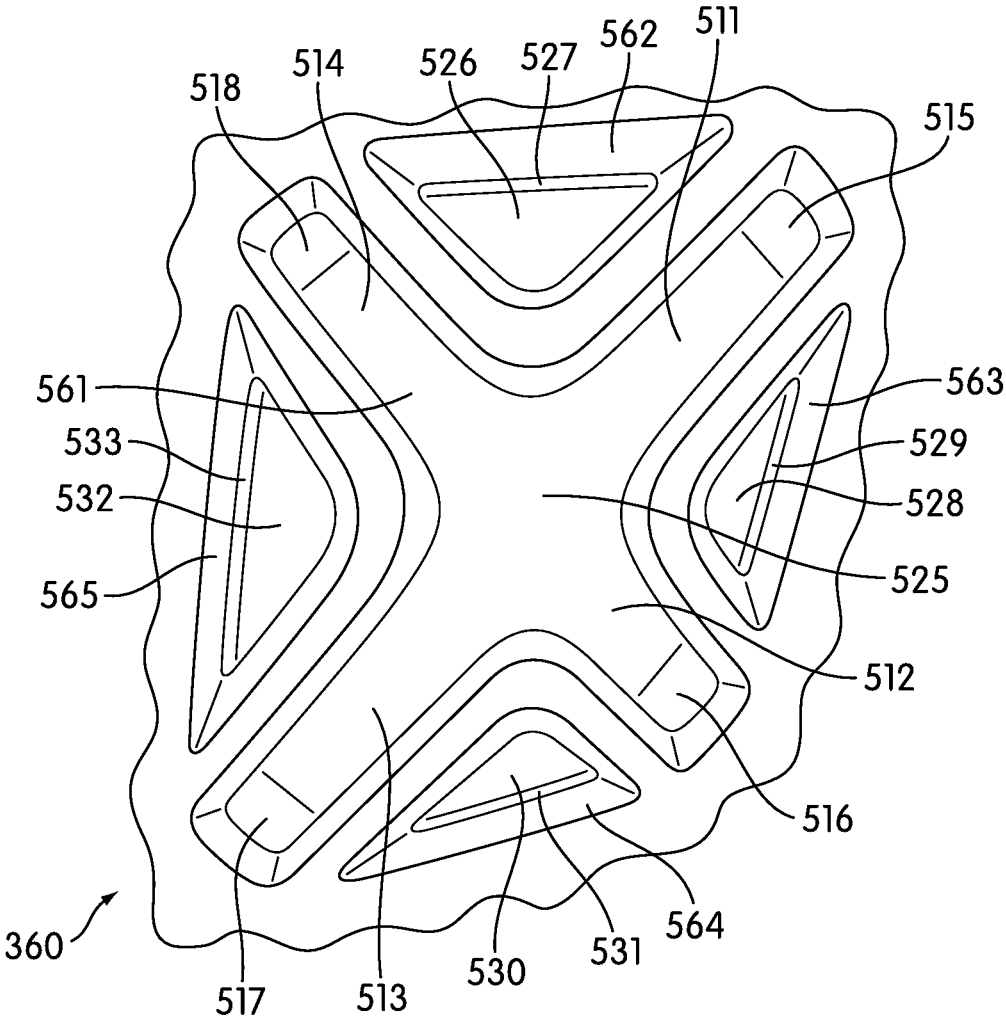
FIG. 5B is an enlarged plan view of a concave traction element cluster from the sole structure of the shoe of FIG. 1.

Outsole 103 also includes three concave traction element clusters (or "clusters") 350, 360 and 410. The clusters may be removably mounted, or may be permanently incorporated into the sole structure (e.g., molded into the outsole). FIG. 5B is an enlarged plan view of cluster 360. Cluster 360 includes a multi-armed cleat 561. Cleat 561 includes four arms 511-514 radiating outward from a center 525. Medial rear arm 512 curves upward and includes a flattened peak 516. Medial forward arm 513 curves upward and includes a flattened peak 517. In a similar manner, lateral rear arm 511 and lateral forward arm 514 curve upward and respectively include flattened peaks 515 and 518. Arms 511 and 513 form a line that is somewhat longer than the line formed by arms 512 and 514.

Cluster 360 also includes four blade cleats 562, 563, 564 and 565. Lateral blade cleat 562 includes a curved inner surface 526 that slopes upward to an edge peak 527. Rear blade cleat 563 includes a curved inner surface 528 that slopes upward to an edge peak 529. Medial blade cleat 564 includes a curved inner surface 530 that slopes upward to an edge peak 531. Forward blade cleat 565 includes a curved inner surface 532 that slopes upward to an edge peak 533.

As can be appreciated from the foregoing description and from FIGS. 3 and 5B, the upwardly sloping surfaces of arms 511-514 and of surfaces 526, 528, 530 and 532 approximate a bowl-shaped structure. Peaks 527, 515, 529, 516, 531, 517, 533 and 518 approximate a rim of that bowl. The presence of blade cleats in the spaces between the peaks of a multi-arm cleat can help to increase traction and foot stability. The bowl-like configuration of cluster 360 allows force from a wearer's weight to be more evenly distributed, thereby reducing damage to putting greens and other surfaces. The shape of cluster 360 can utilize available outsole area more efficiently than a traditional round cleat element.

Clusters 350 and 410 are similar to cluster 360. Each includes a four-armed cleat and four blade cleats in a configuration similar to that of cluster 360. The sizes of clusters 350 and 410 vary somewhat from that of cluster 360, and the orientation of cluster 410 is different from that of clusters 350 and 360. Specifically, the pairs of arms forming a longer line (e.g., arms 511 and 513 of cluster 360) in clusters 350 and 360 are oriented in a forward-medial to rearward-lateral direction. Conversely, the pair of arms forming a longer line of cluster 410 are oriented in a forward-lateral to rearward-medial direction. As with cluster 360, the shapes of clusters 350 and 410 can allow more efficient utilization of available outsole area.

An outsole such as outsole 103 can offer several advantages during golf play. During a backswing, a player typically rolls the leading foot from the lateral side to the medial side and rolls the trailing foot from the medial side to the lateral side. During the downswing and follow-through, the trailing foot rolls from the lateral side to the medial side as the leading foot rolls from the medial side to the lateral side. Peripheral segments 301, 308 and 338 help to arrest foot roll to the lateral side. This can help stabilize the trailing foot at the top of the backswing and stabilize the leading foot during the downswing and follow-through. Peripheral segments 315, 322, 329, 402 and 401 help to arrest foot roll to the medial side. This can help stabilize the leading foot at the top of the backswing and stabilize the trailing foot during early portions of the downswing.

Although arresting foot roll at the top of the backswing and at the conclusion of follow-through can be beneficial, it may be undesirable to impede foot roll between those two points in the swing motion. The inwardly-decreasing heights of the transverse segments allows the player foot to roll comfortably when appropriate, while still helping to reinforce and stiffen the peripheral segments. Flexure zones 203 and 204 also facilitate foot roll and increase comfort while the foot is rolling.

Although the swing is a critical part of golf play, a golfer may spend a large amount of time walking. In some cases, the golfer may be required to walk on potentially slippery surfaces (e.g., a wet grass, sand, slopes and hills, etc.). Tab traction elements 346 provide propulsive traction to the wearer while walking. The sloped edges 501 of tab traction elements 346 can also facilitate beneficial rolling of the foot during a swing. Stud traction elements 347 may provide less propulsive traction than tab traction elements 346, but have a smaller cross section and allow easier penetration of a ground surface. Flexure zones 201 and 202 permit natural flexing of the foot while walking and increase comfort.

Returning briefly to FIG. 1, outsole 103 further includes walls 107 and 108 that extend over portions of the lateral side of the wearer foot. Wall 107 is approximately located adjacent to the outside of the fifth toe. Wall 108 is approximately located adjacent to the outside of the fifth metatarsal-phalangeal joint. Walls 107 and 108 provide additional support to help arrest lateral motion during a swing. A toe cap 106 provides toe protection.

Outsole 103 can be fabricated from any of various materials commonly used for athletic footwear outsoles. Such materials can include synthetic rubbers, "green" rubbers, thermoplastic polyurethane (TPU), etc. In some embodiments, higher durometer materials can be used for some or all traction elements and softer durometer materials can be used for other parts of the outsole. As also seen in FIG. 1, outsole 103 is bonded to a midsole 104. Midsole 104 (FIG. 1) can be formed from compressed ethylene vinyl acetate (EVA) foam (also known as "Phylon"), foamed TPU, or other materials.

Other embodiments include numerous additional variations on the embodiment of outsole 103. The number, locations and arrangements of ridge traction elements can be varied. In some embodiments, for example, ridge traction elements are only included on the lateral or the medial side. The configuration of ridge traction elements could also be varied. For example, a peripheral edge of a ridge traction element could be curved. As examples, a ridge traction element could have a serrated edge, could include intermediate bosses or studs embedded in a segment, etc. The shapes, arrangements and number of tab traction elements and/or stud traction elements and/or concave traction element clusters could also be varied. Other types of traction elements could be included. One or more flexure zones could be omitted.

Figure 6:
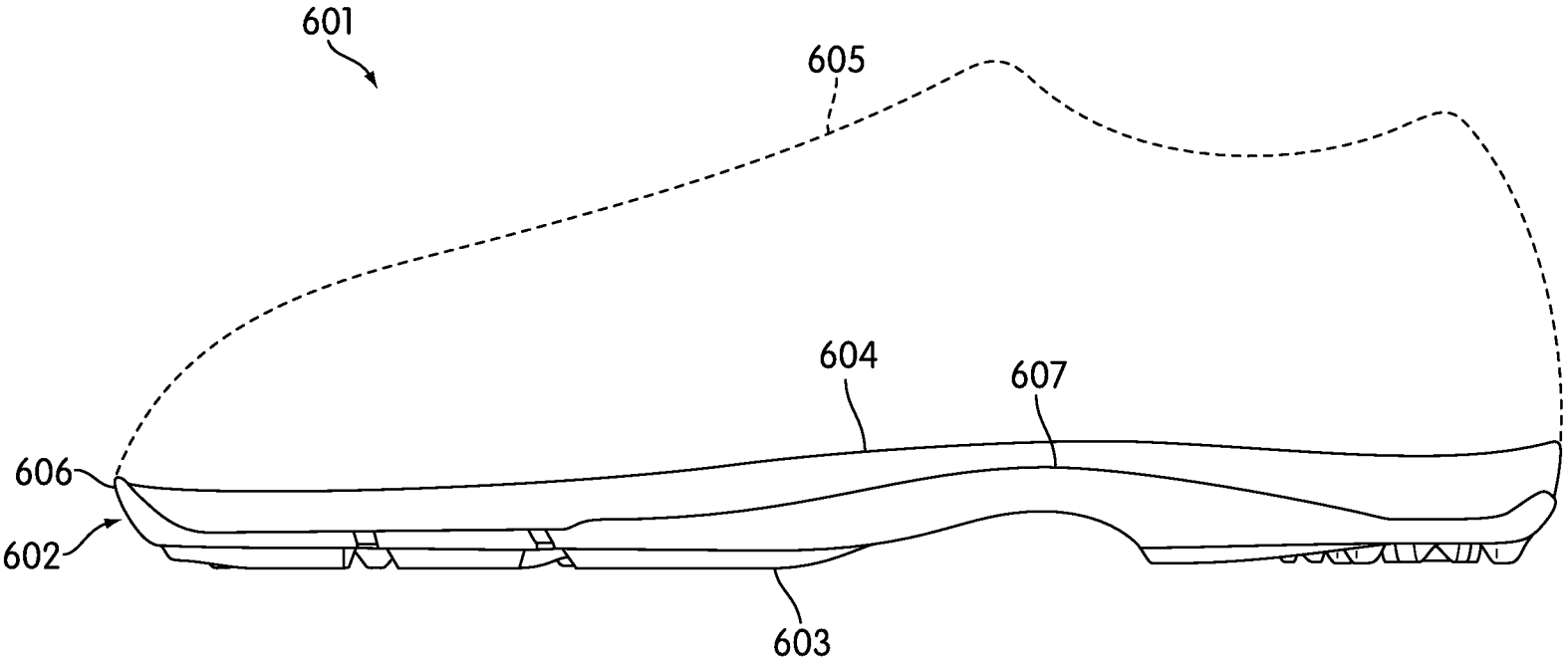
FIG. 6 is a lateral side view of an article of footwear according to another embodiment.

FIG. 6 is a lateral side view of shoe 601 according to another embodiment. Shoe 601, which can also be a shoe intended for wear by a golfer, includes a sole structure 602 having an outsole 603 and a midsole 604. Shoe 601 also includes an upper 605 which, for reasons similar to those indicated in connection with FIG. 1, is shown generically using a broken line. In some embodiments, shoe 101 of FIG. 1 may be a man's shoe and shoe 601 of FIG. 6 may be a woman's shoe.

Figure 7:
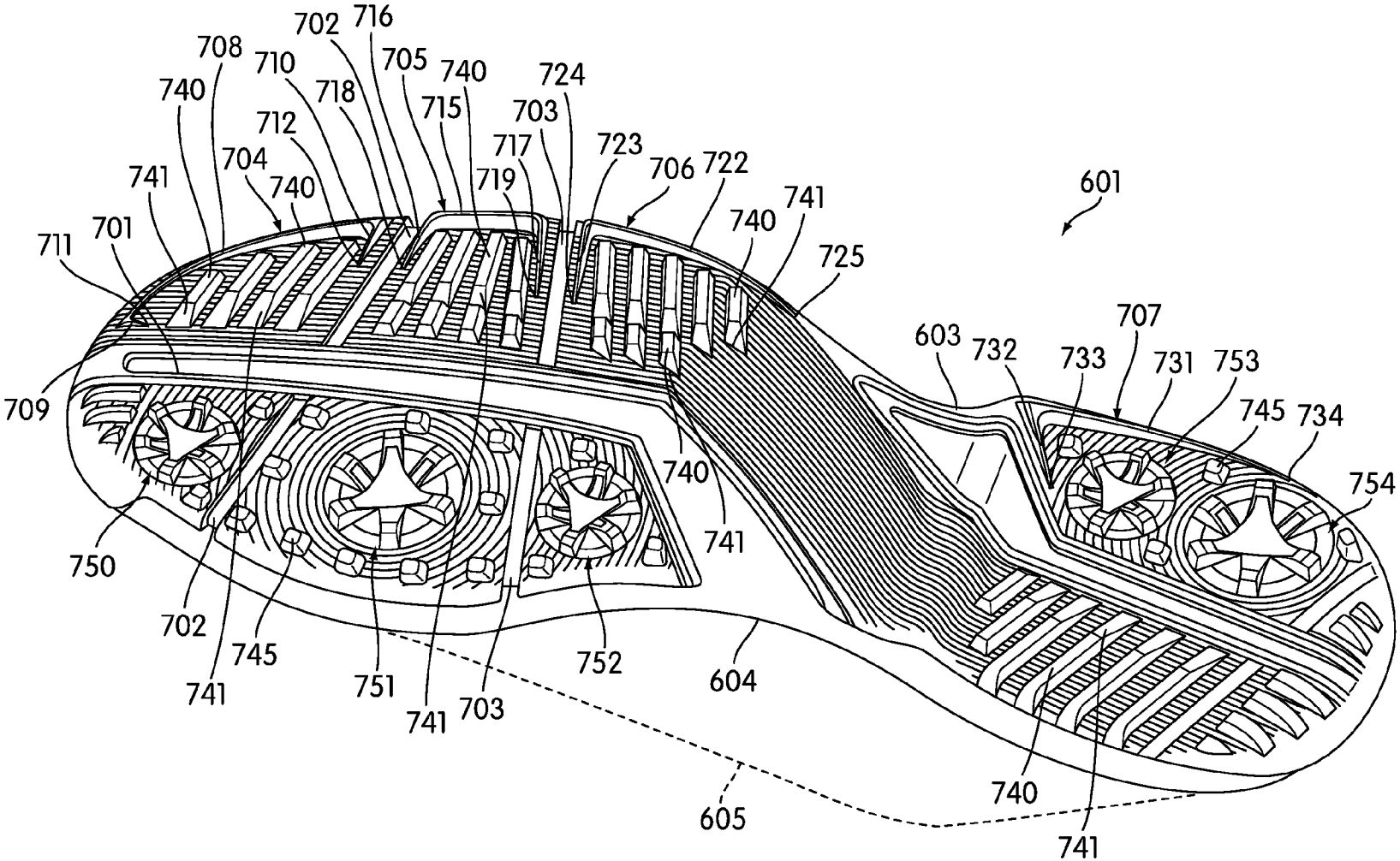
FIG. 7 is a medial bottom perspective view of the shoe from FIG. 6.

FIG. 7 is a medial bottom perspective view of shoe 601 showing details of outsole 603. Unlike outsole 103, outsole 603 does not cover the entire bottom surface of shoe 601. Notably, outsole 603 includes a slot 701 that extends longitudinally through the forefoot, turns to the medial side, and opens in the arch region. Midsole 604 is exposed by slot 701. Slot 701 creates a flexure zone in sole structure 602. Sole structure 602 also includes a flexure zone 702 (partially formed in outsole 603) that extends across sole structure 602 in a medial-lateral direction, and includes a portion approximately located under the first interphalangeal and second proximal interphalangeal joints. Flexure zone 703 (partially formed in outsole 603) also extends across sole structure 602 in medial-lateral direction, and is approximately located under the proximal ends of the proximal phalangeal bones. Flexure zones 702 and 703 include regions in which the material of outsole 603 has been thinned, and in which there are no traction elements present.

Outsole 603 includes ridge traction elements 704, 705, 706 and 707. Ridge traction element 704 includes a peripheral segment 708, transverse segments 709 and 710, and free ends 711 and 712. Ridge traction element 705 includes a peripheral segment 715, transverse segments 716 and 717, and free ends 718 and 719. Ridge traction element 706 includes a peripheral segment 722, a transverse segment 723, and free ends 724 and 725. Ridge traction element 707 includes a peripheral segment 731, a transverse segment 732, and free ends 733 and 734. Peripheral segments 708, 715 and 722 are located near or just outside the outer periphery of a wearer's foot in the forefoot region. Peripheral segment 731 is located near or just outside the outer periphery of a wearer's foot in the hindfoot region. Each of transverse segments 709, 710, 716, 717, 723 and 732 extends across outsole 603 and has a height that tapers along the length of the segment toward the interior of outsole 603. The various segments of ridge traction elements 704-707 have triangular cross-sections similar to the cross-sections of the ridge traction elements of outsole 103.

Ridge traction elements 704-707 operate, in a manner similar to ridge traction elements 211-213 of outsole 103, to arrest medial-to-lateral side foot roll. The inwardly-tapered configuration of the transverse segments of traction elements 704-707 allows the wearer foot to roll comfortably when appropriate, while still helping to reinforce and stiffen the peripheral segments.

Outsole 603 further includes multiple tab traction elements 740. Similar to tab traction element 346 of outsole 103, tab tractions elements 740 provide propulsive traction to the wear while walking. Chamfered ends 741 of tab traction elements 740 can also facilitate beneficial rolling of the foot during a swing. In the embodiment of outsole 603, tab traction elements are flatter and, in at least some cases, have a length-to-width ratio that is generally higher than the length-to-width ratio of tab traction elements 346 of outsole 103. Outsole 603 also includes stud traction elements 745 that are similar to stud traction elements 347 of outsole 103.

Outsole 603 does not include concave traction element clusters such as clusters 350, 360 and 410 of outsole 103. Instead, outsole 603 includes five six-arm cleats 750, 751, 752, 753 and 754. These cleats 750-754 may have any desired construction or structure, and may be removably mounted or permanently incorporated into the sole structure.

Returning to FIG. 6, outsole 603 further includes a wall 607 that extends over portion of the lateral side of the wearer foot. Wall 607 is approximately located in the midfoot region and provides additional support to help arrest lateral motion during a swing. A toe cap 606 provides toe protection.

Like outsole 103, outsole 603 can be fabricated from any of various materials commonly used for athletic footwear outsoles (e.g., synthetic rubbers, "green" rubbers, TPU, etc.). As with outsole 103, higher durometer materials can be used for some or all traction elements and softer durometer materials can be used for other parts of the outsole. Outsole 603 can be bonded to midsole 604, with midsole 604 formed from compressed EVA, foamed TPU, or other materials. Other embodiments include numerous additional variations on the embodiment of outsole 603, including but not limited to variations such as were described in connection with outsole 103.

The foregoing description of embodiments has been presented for purposes of illustration and description. The foregoing description is not intended to be exhaustive or to limit embodiments to the precise form explicitly described or mentioned herein. Modifications and variations are possible in light of the above teachings or may be acquired from practice of various embodiments. The embodiments discussed herein were chosen and described in order to explain the principles and the nature of various embodiments and their practical application to enable one skilled in the art to make and use these and other embodiments with various modifications as are suited to the particular use contemplated. Any and all permutations of features from above-described embodiments are the within the scope of the invention. References in the claims to characteristics of a physical element relative to a wearer of claimed article, or relative to an activity performable while the claimed article is worn, do not require actual wearing of the article or performance of the referenced activity in order to satisfy the claim.

The invention claimed is:

1. An article of footwear comprising:

a sole structure, the sole structure including a flexure zone extending substantially across a forefoot region of the sole structure, the flexure zone forming a region of the sole structure more flexible than adjacent regions of the sole structure, a first ridge fraction element, wherein the first ridge traction element includes a first peripheral segment proximate and generally parallel to an edge of the sole structure in the forefoot region, the first peripheral segment having a substantially continuous height, and the first ridge traction element includes a first transverse segment extending across the sole structure away from the first peripheral segment and surrounded on both sides by adjacent portions of the sole structure, the first transverse segment having a height that decreases along its length as it extends away from the first peripheral segment, no portion of the first transverse segment having a height greater than the height of the first peripheral segment, and a second ridge traction element, wherein the first and second ridge traction elements are separated by the flexure zone, and the second ridge traction element includes a second peripheral segment proximate an edge of the sole structure in the forefoot region and a second transverse segment extending at an angle away from the second peripheral segment.

2. The article of footwear of claim 1, wherein the first and second peripheral segments are positioned in locations near or outside an outer periphery of a wearer foot when the article is worn.

3. The article of footwear of claim 1, wherein the first and second ridge fraction elements are located on a lateral side of the sole structure and the flexure zone is a transverse flexure zone extending substantially across the forefoot region in a medial-lateral direction.

4. The article of footwear of claim 1, wherein the first and second ridge fraction elements are located on a medial side of the sole structure and the flexure zone is a transverse flexure zone extending substantially across the forefoot region in a medial-lateral direction.

5. The article of footwear of claim 1, wherein the first ridge traction element is located on a medial side of the sole structure and the second ridge traction element is located on the lateral side of the sole structure, and wherein the flexure zone is a longitudinal flexure zone extending substantially across the forefoot region in a longitudinal direction.

6. The article of footwear of claim 1, further comprising a third ridge traction element including a third peripheral segment proximate an edge of the sole structure in the forefoot region and a third transverse segment extending away from and at an angle to the third peripheral segment, and a second flexure zone extending substantially across the forefoot region, the second flexure zone forming a region of the sole structure more flexible than regions of the sole structure adjacent to the second flexure zone, and wherein the second and third ridge traction elements are separated by the second flexure zone.

7. The article of footwear of claim 6, wherein the first, second and third ridge traction elements are located on a lateral side of the sole structure, the flexure zone is a transverse flexure zone extending substantially across the forefoot region in a medial-lateral direction, the second flexure zone is also a transverse flexure zone extending substantially across the forefoot region in a medial-lateral direction, and the combined lengths of the first, second and third peripheral segments extend over a majority of the length of the forefoot region.

8. The article of footwear of claim 6, wherein the first ridge traction element is located on a medial side of the sole structure, the second and third ridge traction elements are located on a lateral side of the sole structure, the flexure zone is a longitudinal flexure zone extending substantially across the forefoot region in a longitudinal direction, and the second flexure zone is a transverse flexure zone extending substantially across the forefoot region in a medial-lateral direction.

9. The article of footwear of claim 7, wherein each of the second and third transverse segments has a height that decreases along its length.

10. The article of footwear of claim 1, wherein the first ridge traction element at least partially bounds a first region of the outsole, the second ridge traction element at least partially bounds a second region of the outsole, each of the first and second regions includes additional traction elements.

11. The article of footwear of claim 10, wherein at least a portion of the additional traction elements are tab traction elements, each of the tab traction elements has a length along a length axis greater than a width across a width axis, and the length axis of each of the tab traction elements is oriented in a medial-lateral direction across the outsole.

12. The article of footwear of claim 11, wherein each of the tab traction elements includes a sloped end positioned to accommodate rolling of a wearer foot in a medial-to-lateral direction.

13. The article of footwear of claim 10, wherein at least one of the additional traction elements is a concave traction element cluster.

14. The article of footwear of claim 1, wherein the second peripheral segment is proximate and generally parallel to an edge of the sole structure in the forefoot region and has a substantially continuous height, and the second transverse segment extends across the sole structure away from the second peripheral segment and is surrounded on both sides by adjacent portions of the sole structure, the second transverse segment having a height that decreases along its length as it extends away from the second peripheral segment, no portion of the second transverse segment having a height greater than the height of the second peripheral segment.

15. The article of footwear of claim 14, wherein the sole structure lacks traction elements, between the first peripheral segment and a portion of the edge to which the first peripheral segment is proximate, having a height greater than a height of the first peripheral segment, and the sole structure lacks traction elements, between the second peripheral segment and a portion of the edge to which the second peripheral segment is proximate, having a height greater than a height of the second peripheral segment.

16. An article of footwear comprising:

a sole structure including a first ridge traction element, the first ridge traction element including a first peripheral segment proximate and generally parallel to one of a medial or lateral edge of the sole structure in the forefoot region, the first peripheral segment having a substantially continuous height, the first ridge fraction element including a first transverse segment extending across the sole structure away from the first peripheral segment and surrounded on both sides by adjacent portions of the sole structure, the first transverse segment terminating in a first free end without reaching the other of the medial or lateral edge, the first transverse segment having a height that decreases along its length as it extends away from the first peripheral segment, no portion of the first transverse segment having a height greater than the height of the first peripheral segment, and a second ridge traction element, the second ridge traction element including a second peripheral segment proximate the one of the medial or lateral edge of the sole structure in the forefoot region, the second peripheral segment located forward of the first peripheral segment, the second ridge traction element including a second transverse segment extending away from and at an angle to the second peripheral segment, the second transverse segment terminating in a second free end without reaching the other of the medial or lateral edge.

17. The article of footwear of claim 16, wherein each of the first and second peripheral segments is positioned in a location that is near or outside an outer periphery of a wearer foot when the article is worn.

18. The article of footwear of claim 16, wherein the sole structure includes a transverse flexure zone separating the first and second ridge traction elements.

19. The article of footwear of claim 16, wherein each of the first and second peripheral segments is proximate the lateral edge of the sole structure in the forefoot region.

20. The article of footwear of claim 19, wherein the sole structure includes a third ridge traction element, the third ridge traction element including a third peripheral segment proximate the medial edge of the sole structure in the forefoot region, the third ridge traction element including a third transverse segment extending away from and at an angle to the third peripheral segment, the third transverse segment terminating in a third free end without reaching the lateral edge.

21. The article of footwear of claim 20, wherein the sole structure includes a longitudinal flexure zone separating the third ridge traction element from the first and second ridge traction elements.

22. The article of footwear of claim 21, wherein the sole structure includes a transverse flexure zone separating the first and second ridge traction elements.

23. The article of footwear of claim 16, wherein the sole structure includes a third ridge traction element, the third ridge traction element having a third peripheral segment proximate an edge of the sole structure in the hindfoot region, the third ridge traction element including an additional segment extending away from and at an angle to the third peripheral segment and terminating in a third free end.

24. The article of footwear of claim 16, wherein the first ridge traction element at least partially bounds a first region of the outsole, the second ridge traction element at least partially bounds a second region of the outsole, each of the first and second regions includes additional traction elements.

25. The article of footwear of claim 24, wherein at least a portion of the additional traction elements are tab traction elements, each of the tab traction elements has a length along a length axis greater than a width across a width axis, and the length axis of each of the tab traction elements is oriented in a medial-lateral direction across the outsole.

26. The article of footwear of claim 24, wherein at least one of the additional traction elements is a concave traction element cluster.

27. The article of footwear of claim 16, wherein the second peripheral segment is proximate and generally parallel to the one of the medial or lateral edge of the sole structure in the forefoot region and has a substantially continuous height, and the second transverse segment extends across the sole structure away from the second peripheral segment and is surrounded on both sides by adjacent portions of the sole structure, the second transverse segment having a height that decreases along its length as it extends away from the second peripheral segment, no portion of the second transverse segment having a height greater than the height of the second peripheral segment.

28. The article of footwear of claim 27, wherein the sole structure lacks traction elements, between the first peripheral segment and a portion of the one of the medial or lateral edge to which the first peripheral segment is proximate, having a height greater than the height of the first peripheral segment, and the sole structure lacks traction elements, between the second peripheral segment and a portion of the one of the medial or lateral edge to which the second peripheral segment is proximate, having a height greater than the height of the second peripheral segment.

* * * * *

UNITED STATES PATENT AND TRADEMARK OFFICE

CERTIFICATE OF CORRECTION

PATENT NO. : 8,418,382 B2
APPLICATION NO. : 13/049422
DATED : April 16, 2013
INVENTOR(S) : Carl L. Madore et al.

It is certified that error appears in the above-identified patent and that said Letters Patent is hereby corrected as shown below:

Title Page 2, item (56), under Foreign Patent Documents:
Please delete "10/2000" for Foreign Priority document JP 2002306207 and replace with --10/2002--

Signed and Sealed this
Nineteenth Day of August, 2014

Michelle K. Lee

Michelle K. Lee
*Deputy Director of the United States Patent and Trademark Office*